United States Patent [19]

Karhu et al.

[11] Patent Number: 4,562,668

[45] Date of Patent: Jan. 7, 1986

[54] WINDOW STRUCTURE, A HINGE AND A LATCH SUITABLE FOR IT AND A COVER PROFILE FOR SAID STRUCTURE

[75] Inventors: Niilo Karhu, Vantaa; Jussi Pesola, Helsinki, both of Finland

[73] Assignee: Lemminkainen Oy, Helsinki, Finland

[21] Appl. No.: 617,539

[22] Filed: Jun. 5, 1984

[30] Foreign Application Priority Data

Jun. 16, 1983 [FI] Finland ..... 832196
Oct. 27, 1983 [FI] Finland ..... 833942

[51] Int. Cl.[4] ..... E05D 15/00

[52] U.S. Cl. ..... 49/381; 49/394; 49/501; 292/216

[58] Field of Search ..... 49/381, 394, 463, 501; 292/216, 219

[56] References Cited

U.S. PATENT DOCUMENTS

| | | | |
|---|---|---|---|
| 1,711,213 | 4/1929 | Smith | 49/394 X |
| 2,352,727 | 7/1944 | McMahon | 49/463 X |
| 2,924,862 | 2/1960 | Pellicore | 49/394 X |
| 3,877,740 | 4/1975 | Carvell et al. | 292/216 |

*Primary Examiner*—Kenneth Downey
*Attorney, Agent, or Firm*—Oblon, Fisher, Spivak, McClelland & Maier

[57] ABSTRACT

The present invention relates to a window structure comprising a frame capable of being secured to a window opening, and hinges and latches fitted in the frame. The frame is preferably made up of an aluminum profile having the same cross section all around the frame. A substantial part of the profile consists of the interior part which receives the pane and has the shape of an open tube. Both the hinge and the latch are fitted in the open tube, to which they attach rotatably without any furniture or other fastening means. Both the hinges and the latches can be simply pressed into the open tube and be removed from it without dismantling the window structure in any way. Owing to the symmetry of the window structure the left- or right-handedness of the window can be determined as late as at the installation stage.

The invention also relates to a hinge and a latch functioning in an open-tube-shaped frame structure.

The invention further relates to a cover profile for the frame part of a window structure or the like. The object of this part of the invention is to provide an inexpensive and easily installable cover profile, which can be adjusted without steps so that the same profile can be used between the window frame part and the adjacent wall or the adjacent window even if this clearance varies in width. This is implemented by using a cover profile according to the invention, at least one edge of which is flat and intended to be pushed into a pocket-like opening in the frame part.

The cover profile according to the invention can also be shaped to form a drip sheet for the window.

20 Claims, 15 Drawing Figures

6
22
21
24
3
1
23
6

Fig. 9
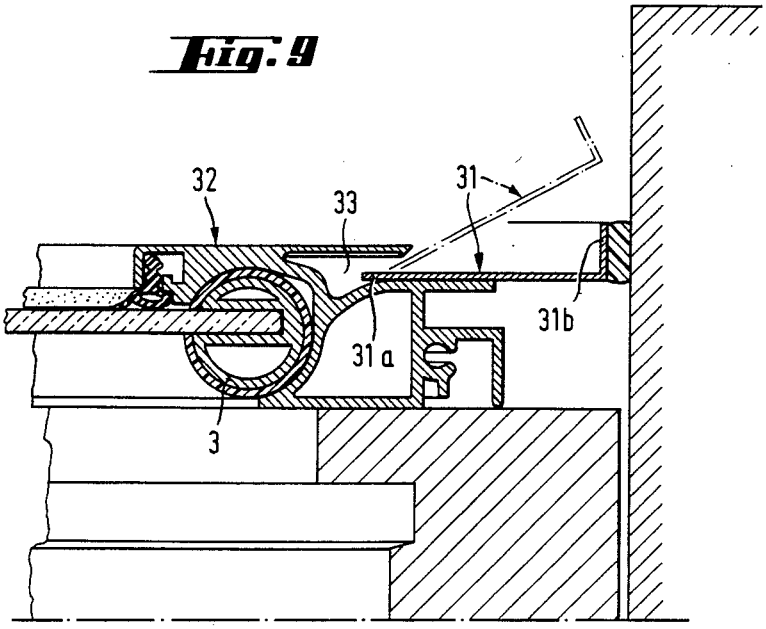
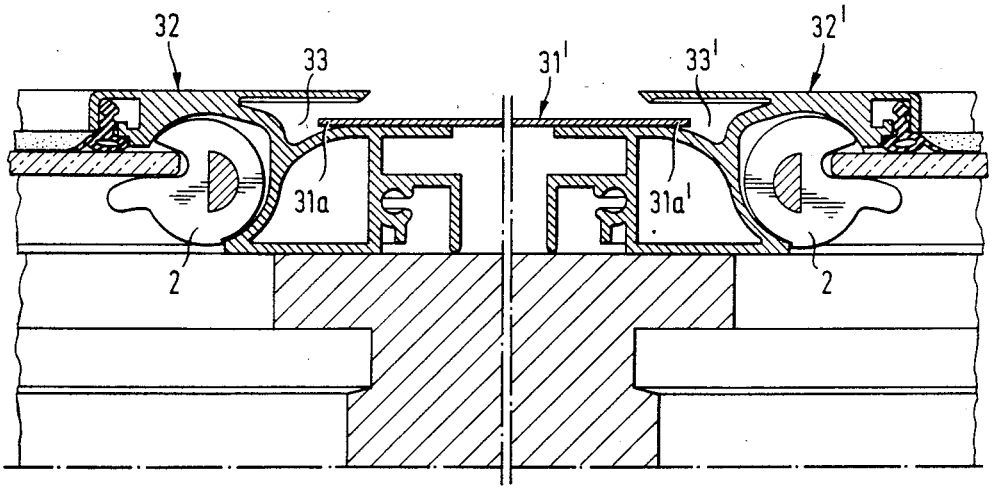
Fig. 10

WINDOW STRUCTURE, A HINGE AND A LATCH SUITABLE FOR IT AND A COVER PROFILE FOR SAID STRUCTURE

FIELD OF THE INVENTION

The present invention relates to a window structure which comprises a frame capable of being secured to a window opening, hinges mounted in the frame for securing the pane movably to the frame. The invention also relates to a hinge for an open-tube-shaped frame structure frame for opening or closing a glass pane, door, hatch or a similar structure. The invention further relates to a cover profile for the frame of a window structure or the like.

OBJECTS

One object of the invention is to provide a window structure which can be adapted simply to openings of different sizes and which can be mounted in place for left-handed or right-handed opening. A further object is to construct the whole frame from the same material. This will reduce the manufacturing and storage costs.

The window structure according to the invention is specifically intended for use together with a sashless window pane, especially together with an additional-window structure according to Finnish Pat. No. 58 674. A sashless window pane is easy to wash but, in order to close tightly, it requires a relatively large number of fastening furniture. Such conventional latches and other window furniture form protrusions which complicate washing and other maintenance and, furthermore, increase the otherwise economical price of sashless pane. In order that all the advantages of a sashless pane could be exploited, it should not have any of the said protrusions which complicate maintenance. A further object of the present invention is therefore to provide latches and hinges, inexpensive to manufacture, which leave the pane surface maximally bare and can be installed at any point in the window frame without specific fastening devices.

Known cover profiles are metal, plastic or rubber profiles, and they are generally used in conjunction with metal frame profiles. The cover profile is secured on the one hand to the frame of a window or the like and on the other hand to the surrounding opening in the wall. Though the window opening is adapted to the window size, there appears, however, some variation in the dimensions between them. Therefore, the cover profile must also have the respective variation of dimensions in order that its securing to the frame and the wall be successful. Consequently, cover profiles of different dimensions must be manufactured and, above all, on the site there must be on hand profiles of different dimensions, from among which the suitable profile is selected for each place. An even greater difficulty is encountered when there is variation in the dimensions in one and the same window opening, which is by no means unusual. This occurs above all in old buildings, in which case the difficulty is encountered when window structures are replaced. The slant appearing in the window opennings of such buildings results in that a profile which fits, for example, at the upper edge of the window no longer fits at the level of the lower edge of the window. In this case the profile has to be worked at the time it is installed, if possible, or the thickness of the seal has to be increased at that end of the profile which comes against the wall. Such additional steps slow down the installation and, of course, make it more expensive.

A further object of the present invention is therefore to eliminate the said disadvantages and to provide a cover profile the design of which is such that it can be fitted between the frame and the wall or the adjacent window even if the width of this clearance varies.

SUMMARY OF THE INVENTION

These objects are achieved with the window frame according to the invention, the hinge according to the invention, the latch according to the invention, and the cover profile according to the invention, the main characteristics of which are given in accompanying claims 1, 11, 17, and 23, respectively. The invention is based on the main idea that the essential part of the frame profile encircling the window is made up of a tube of a substantially circular cross section, which lacks an axial mantle section of a certain size, in other words an open tube. Both the hinges and the latches are fitted in this open tube. The tube functions at the same time as a water collector and a pressure-equalizing turbulence chamber if water or air penetrates inside the glass under some circumstances, for example in a case in which some latch is not properly closed. In the tube there is preferably formed a longitudinal groove in which the water entering the tube accumulates. The water flows out of the structure through perforations which are formed in the groove or at a corresponding point in the tube. The said groove is produced in the frame profile during its manufacturing process, at the extrusion stage. The groove is thus present in every part of the frame, but water removal perforations can be formed, when so desired afterwards in the lower part of the frame.

The arc length of the mantle section removed from the open tube is at minimum 90°, preferably within the range of approximately 100°–130°. Since the opening is smaller than 180°, the hinges and latches operating in it remain in the tube. Such an opening size enables the pane to open 90°. The edges of the open tube cooperate with the latch operating in such a way that a shoulder formed on the circumference of the latch presses against one edge of the open tube, while the opposite side of the circumference of the latch presses wedgingly against that edge part which ends at the opposite edge of the open tube, thus producing the locking action of the latch.

The frame profile additionally includes a sealing groove into which a suitable seal is fastened for the pane, an external smooth part which forms most of the surface visible outwards and can be given a treatment matching the outward appearance of the building or covered with a cover strip of the desired type, and a frame support part which gives the structure rigidity and by which the frame is secured to the window opening or to an old window.

The forming of a window frame from the window structure parts according to the invention is simple. The different parts of the frame are simply cut at an angle of 45° in relation to their longitudinal direction and are fastened to each other in a conventional manner. The window structure is symmetrical in relation to the horizontal axis, and so it is not necessary at the manufacturing stage to take account of whether the window will be left-handed or right-handed. Hinges and latches according to the invention can be fitted in the window frame also after the frame parts have been joined together, and so the hinging side can be easily altered also after the window structure according to the invention is installed in place.

The frame profile is preferably made from aluminum, the excellent extrusion properties of which can be exploited in the best possible manner both technically and economically. Both the hinges and the latches can be manufactured from, for example, an extruded bar-like material without any other machining than cutting, which, of course, means very low manufacturing costs. The hinges are made from, for example, aluminum or plastic, the latches preferably from plastic.

The hinge is made up of a cylindrical part to which the pane is secured in a suitable manner. The cylindrical part has, for example, a notch to which the edge of the pane is glued. Around the bar-like part of the hinge there is preferably a separate sleeve-like part made from plastic or some similar material, which forms a bearing surface for the bar-like part when it turns in the open tube. The sleeve-like bearing surface can also slide against the open tube. This enables the window pane, secured to the hinges, to be removed from the open tube of the frame, since the width of the opening in the open tube is the same or slightly greater than the hinge diameter. The sleeve-like part fitted over the hinge increases the hinge diameter so that the pane cannot come out of the frame. The sleeve-like part has preferably the same diameter as the open tube, not taking account of the groove formed in the open tube. The cylindrical hinge part can also itself function as a bearing surface against the interior wall of the open tube. In this case the hinge part is preferably of plastic.

The corner hinges of the window pane are preferably fitted with a detachably fastened hemispherical bearing piece, the hinge rotating supported by it. The exterior shape of the bearing piece corresponds to the frame corner formed by the open tubes. The bearing piece at the upper corner is without function in the use of the window pane, but it promotes safe transport of the pane. Fitting a bearing piece at both corners also enables the pane to be turned upside down if the opening direction of the window so requires.

Hinge pieces can be secured to the pane in such a number that a tight closing is achieved against the seal of the frame. The hinge structure is such that the hinges are automatically on the same axis, and so no stresses detrimental for the functioning of the window are created. The hinge structure allows the pane to open 90°, which is sufficient for the maintenance of the window and for ventilation.

In the cylindrical hinge piece there are preferably formed in its transverse direction one or two openings having a crescent-shaped cross section. The purpose of the openings is on the one hand to lighten the structure and to save material and on the other hand to provide an opportunity to attach some additional member to the hinge. It is possible, for example, to attach a flat spring to the hinge to cause the pane to open automatically when the latch releases the pane, or respectively to cause the pane to close. It is thus possible to replace the with the flat spring fitted to the hinge the so-called wind latch necessary in a ventilation window, which keeps two ventilation windows locked to each other. The flat spring can also be installed in such a way that it keeps the pane closed against the seals, in which case the pane can be used, for example, for obtaining replacement air in connection with mechanical ventilation in such a way that in the manner of a back-pressure valve it prevents a possible underpressure from being discharged from the room space.

The latch structure according to the invention is made up of a piece of plastic or other suitable material, rotating inside the open tube of the frame and having on one side a notch for the pane. Immediately adjacent to the notch there is preferably a protrusion which can be pressed to close the latch. Furthermore, on the circumference of the latch there is a shoulder, so-called locking shoulder, which presses against one edge of the open tube of the frame, whereby the latch piece forms a kind of wedge between the two edges of the open tube and at the same time presses the pane edge against the frame seal. The locking shoulder can be released by pressing the latch at the opening of the open tube, at which time the latch turns inside the tube and the pane edge is released. The latch has advantageously an axial boring with a cross section of the shape of, for example, a circle segment. The purpose of the opening is to lighten the structure or to create room for a member to be attached therein.

A segment is preferably removed along the circumference of the latch, approximately opposite the notch. The length of the diameter of the latch in the segment area is approximately the same as or somewhat smaller than the distance between the edges of the open tube. When the latch is in the non-locked state it can thus be simply removed from the frame or be fitted into it. The latch can be removed from the open tube also without the said segment cut, when the pane is open and the latch is at a certain angle of rotation. The latches are locked in place in the open tube by means of, for example, latch rings or simply by bending the edges of the open tube inwards above and below the latches. In each case, the necessary number of latches are fitted in the frame tube on the sides requiring them, in accordance with the window size, wind conditions, etc. A latch at the lower edge of the window also serves as a bearing member when a wide window is concerned.

In ventilation windows it is possible to use a long latch formed from latches according to the invention, having several latches linked together in order to provide several locking points. The long latch is made up of a suitable torsionally rigid rod, around which the desired number of these latches are fitted. One of these latches forms an operating and locking piece. The cross section of the other latches is otherwise the same as that of the locking piece, but they lack the locking shoulder described above. They keep the pane locked by torsion-rod transmission.

The profile according to the invention is used together with a frame part which has a pocket-like opening into which one flat edge of the cover profile is simply pushed and secured to it by means of, for example, a spring or a screw. The other edge of the cover profile is flat or shaped into a small bend. The securing to the surrounding wall is carried out either by means of an adhesive sealing tape attached to the bend, a rubber profile fitted to the edge, or simply by tightening the profile between the attachment of its one edge and the adjacent wall. If the other edge of the cover profile is secured to an adjacent window, this is done in the same way as the securing of the first edge. For sealing it is advantageous to use a seal which expands under the effect of moisture after its installation and thus produces an effective seal. If the window opening is slanted and the frame of the window is rectangular throughout, the clearance produced is covered by the cover profile according to the invention, the straight edge of the profile pushing to a different depth in the opening in the frame, the profile being thus adjustable without steps.

If there are two adjacent windows fitted in the same window opening, the clearance between them can be covered with a cover profile which serves as an intermediate sheet, its both edges being flat. The cover profile is first pushed into the pocket in one frame, so deep that the other edge of the profile can be pushed into the opposite pocket in the second frame. The cover profile according to the invention can also be installed as a horizontal profile at the upper or lower edge of the window. A cover profile bent into a suitable shape can be fitted to serve as the drip sheet in the lower part of the frame. The securing is done in the same manner as described above.

The cover profile according to the invention is inexpensive owing to its simple structure, and it is easy to work, when necessary, at the installation site.

BRIEF DESCRIPTION OF THE DRAWINGS

The invention is described below in greater detail in the form of preferred embodiments and with reference to the accompanying drawings, in which

FIG. 9 depicts a horizontal section of a cover profile fitted between a window frame profile and the surrounding wall, FIG. 10 depicts a horizontal section of a cover profile fitted between the frame profiles of two windows.

DESCRIPTION OF THE PREFERRED EMBODIMENTS

Figure 1:
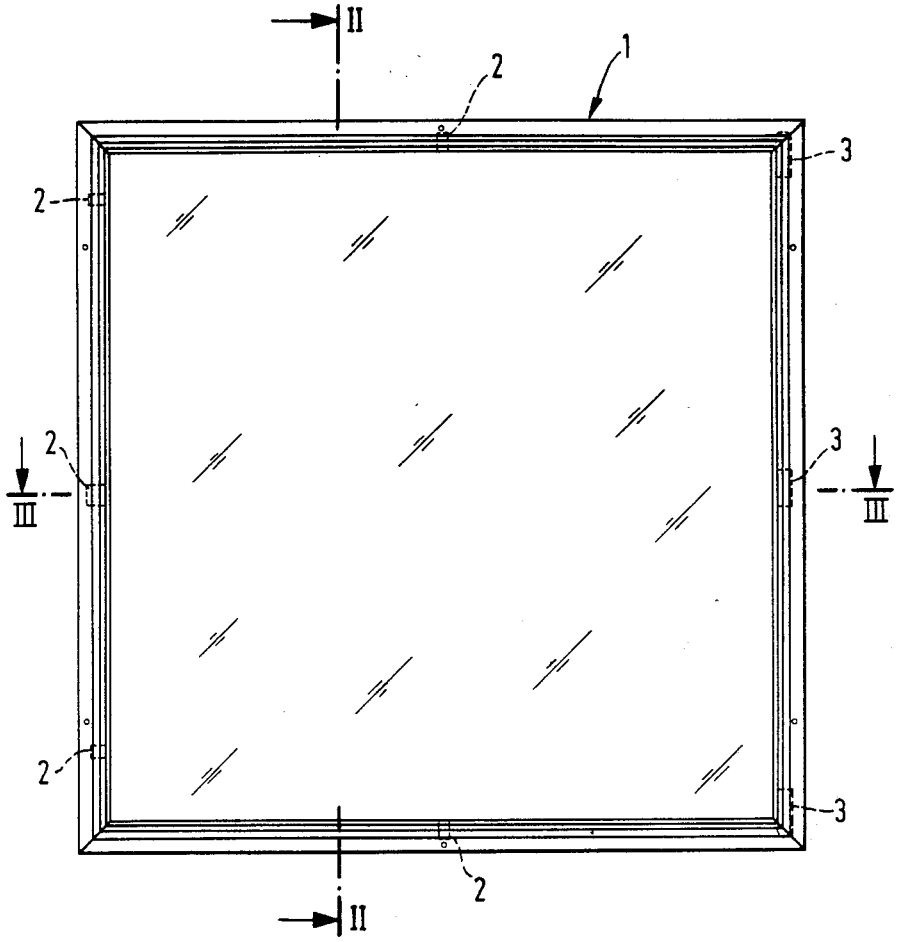
FIG. 1 depicts a front view of a completed window structure according to the invention, in which the pane is installed in the frame and the frame has a suitable number of hinges and latches.

The same reference numerals are used in all the figures, except FIGS. 9–12, to indicate the same structural parts. The figures disclose the preferred embodiments of the invention.

FIG. 1 shows a completed window structure as seen from the front and provided with latches 2 and hinges 3.

Figure 2:
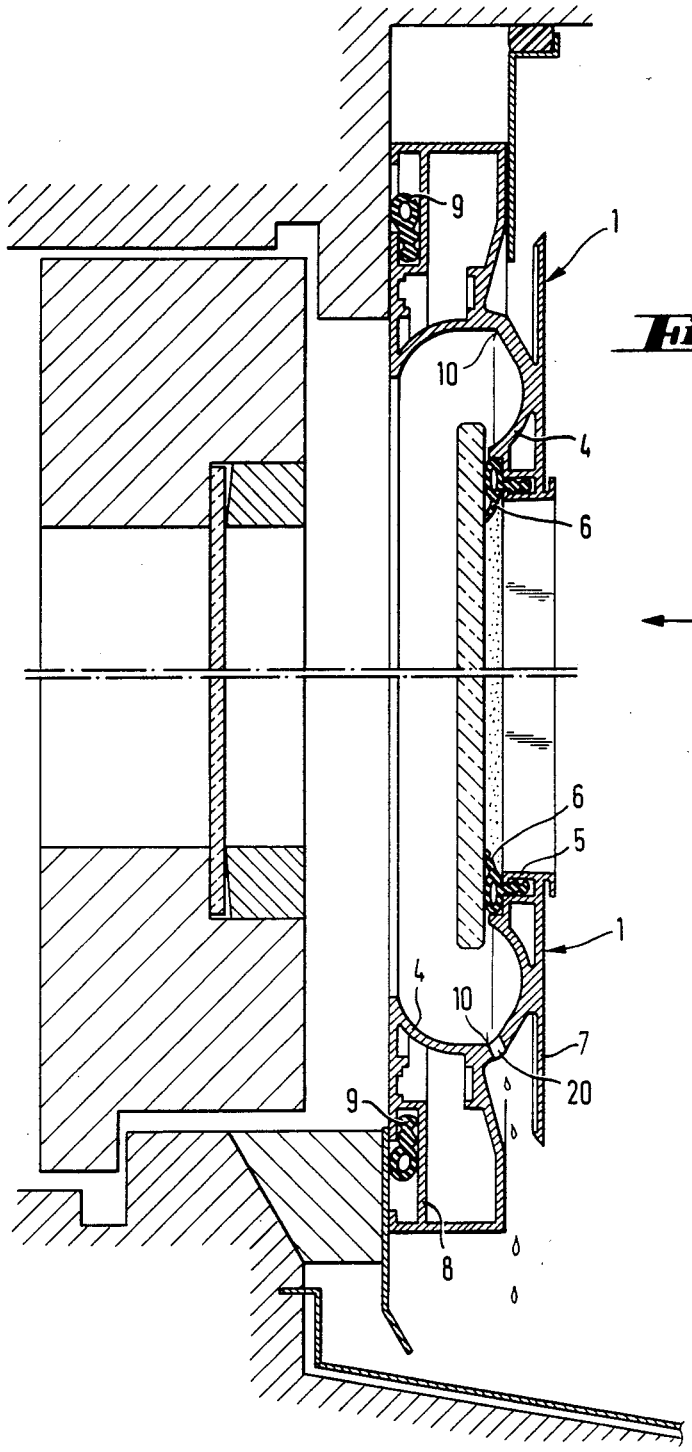
FIG. 2 depicts an enlarged vertical section along line II—II in FIG. 1, with the window frame fastened to an old window.

FIG. 2 presents a vertical section of the window structure, showing the structure of the frame profile 1 and the installation of the pane in it. The frame is installed in the frame work of an old exterior window and forms there an additional window structure which protects the old frame and sash parts and provides thermal and sound insulation. The essential parts of the frame profile include an open tube part 4 which receives the pane, a sealing groove 5 into which the pane seal 6 is fitted, an exterior smooth part 7 which forms the surface which is seen outwards and which can be painted in a suitable color or be covered with a suitable cover strip, and a frame support part 8 by which the frame is secured to the window structure under it. The support part 8 has a groove for a seal 9 which comes against the structure under it. The support part 8 is the rigid part of the profile and gives the frame structure the required strength and rigidity. The length of the open arc of the open tube part 4 is about 100°–120°. The hinges and latches fitted in the open tube remain securely inside the tube, since their outer diameter is the same as the inner diameter of the open tube. A groove 10 made in the open tube 4 is clearly visible in the figure, and the lower frame part is provided with perforations 11 for the removal of water. The groove 10 has been fitted between the exterior smooth part 7 and the support part 8, whereby water can suitably run off along the wall of the support part 8. The opentube structure of the frame profiles provides a certain adjustment tolerance with respect to the pane size. The hinges and latches to be mounted in the open tubes somewhat restrict this adjustment tolerance, since they require a certain length of glass edge in order to function reliably. The location of the opening of the open tube 4 in the frame profile 1 is fitted as far as possible towards the opening for light, in which case the profile covers as little as possible of the opening for light. FIG. 2 presents an approximately optimal structure in this respect.

Figure 3:
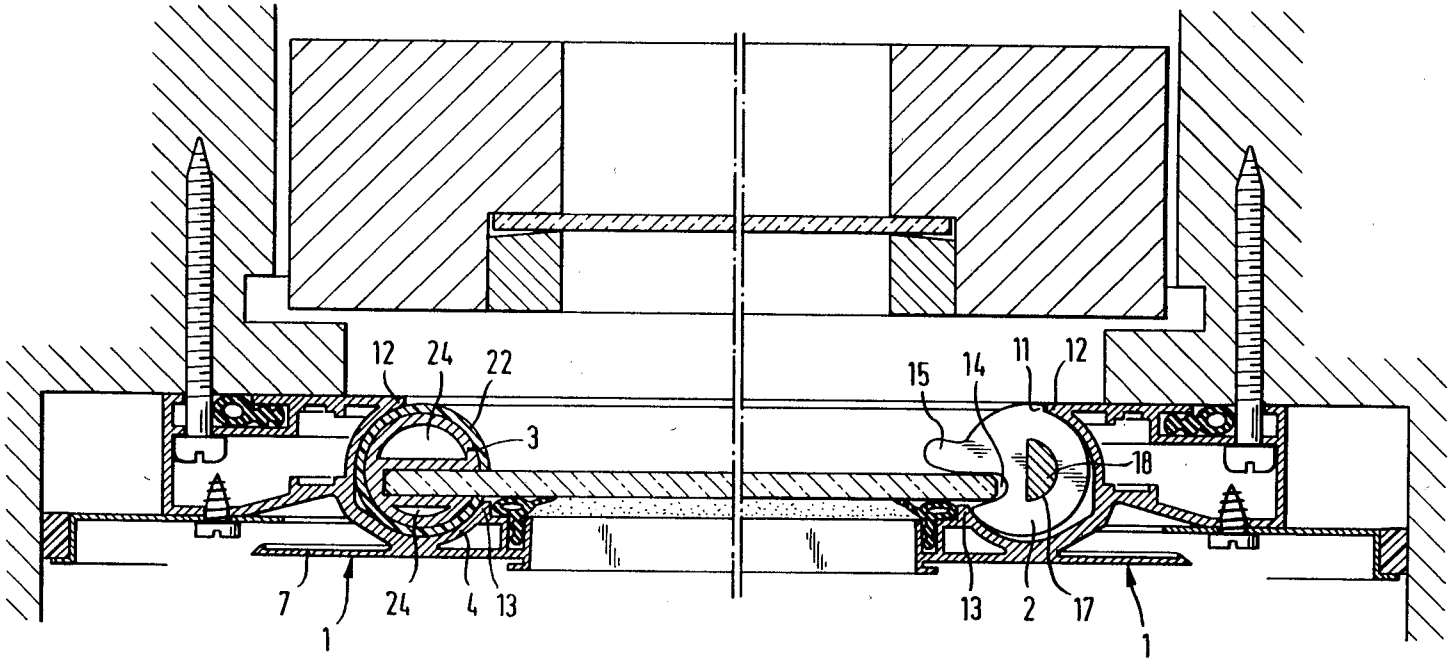
FIG. 3 depicts a horizontal section along line III—III in FIG. 1, with the window structure fastened to an old window.
Figure 7A:
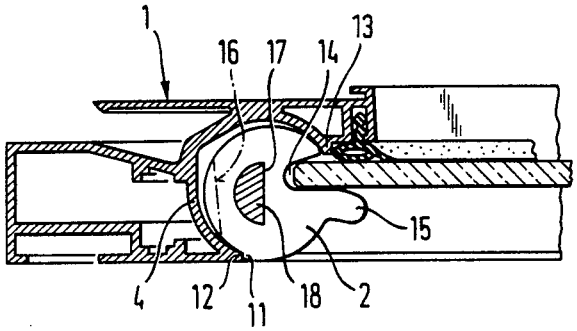
FIG. 7*a* depicts a cross section of a latch according to the invention when it is in the locking position.
Figure 7B:
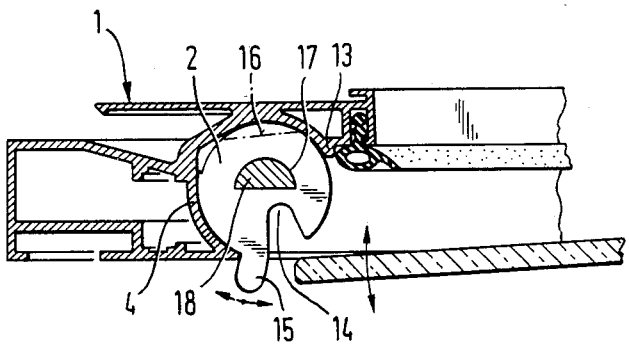
FIG. 7*b* depicts the same as FIG. 7*a* but when the latch is in the non-locking position.

FIG. 3 depicts the same window structure as FIG. 2, but as a horizontal section. The section has been made along line III—III in FIG. 1, through the latch 2 and the hinge 3. The latch 2 is seen as a substantially circular piece fitted in the open tube 4. The outer diameter of the latch 2 and the inner diameter of the open tube 4 are the same and their cross sectional surfaces substantially correspond to each other. A small wedge-like piece has been removed along the circumference of the latch in order to form a locking shoulder 11. When the latch is being turned counterclockwise, in the embodiment of the figure to the locking position, the interior edge 12 of the open tube presses against the locking shoulder. At the same time the latch moves, to a somewhat eccentric position in relation to the open tube, at which time the latch wedges between the interior edge 12 and the interior surface of the circumference ending at the exterior edge 13. The latch has a notch 14 formed in the circumference for the edge of the pane to be locked. The notch 14 allows a small tolerance for pane size. On the circumference of the latch, inwards from the notch, there is a protrusion 15 by which the latch is turned to the locking position. The latch is triggered by pressing the latch between the locking shoulder 11 and the protrusion 15. Thereby the locking shoulder is pressed inside the edge 12 and the latch moves back to a central position in relation to the open tube, whereby the wedge effect is eliminated and the latch can turn clockwise, thereby releasing the pane edge. The locking position of the latch is depicted in FIG. 7*a* and the releasing position in FIG. 7*b*. In the same figures there is drawn with dotted lines 16 and alternative circumference shape of the latch, from which a segment-shaped piece has been removed. This shape helps the removal of the latch from the open tube by turning the latch counterclockwise without the pane coming between the latch and the profile, in which case the narrower diameter at the segment in question facilitates the removal of the latch from between the open-tube edges 12 and 13. Latches of this shape can be very simply added to the window structure and also removed from it while the window is open.

Figure 8A:
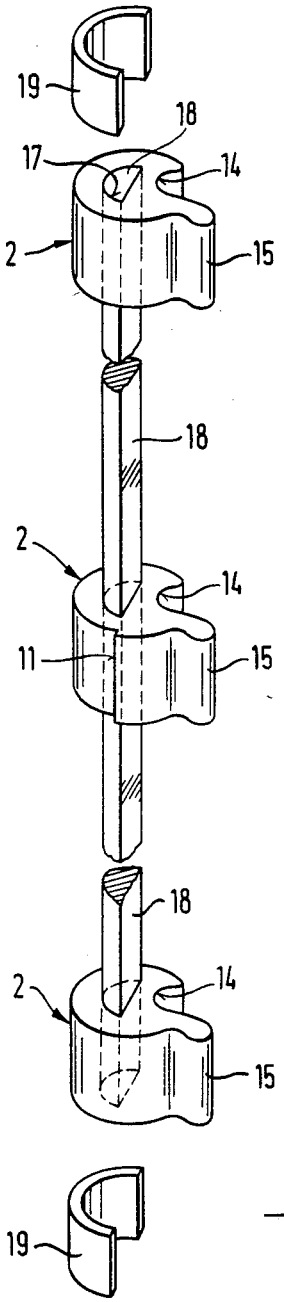
FIG. 8*a* depicts a long latch assembled from latches according to the invention, with its locking latch rings.
Figure 8B:
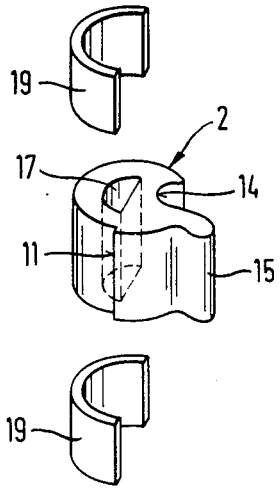
FIG. 8*b* depicts a latch according to the invention with its latch ring.

The latch has preferably a longitudinal opening or boring 17, which is shown as having the shape of a semi-circle in FIGS. 3, 7 and 8. The opening 17 can be used for forming a long latch. Such a latch is shown in FIG. 8*a*, and in the embodiment depicted it is made up of three latches through which a torsionally rigid rod 18 has been passed. By means of the long latch several locking points are obtained, all of which are operated by means of one latch. In a long latch according to FIG. 8*a* the middle latch is provided with a locking shoulder 11, and the locking and opening of the latch is effected by turning this latch and by pressing it in. The latches at the ends of the long latch turn along with the rod 18 and produce the same locking effect as does the middle latch. Separate latches, or respectively a long latch, are secured in place in the open tube by means of, for example, latch rings 19, which are shown in FIGS. 8*a* and 8*b*. Alternatively, the latches can be secured in place in a simple way by cutting the edges 12 and 13 of the open tubes above and below the latches, whereby stops are formed in the open tube.

Figure 4:
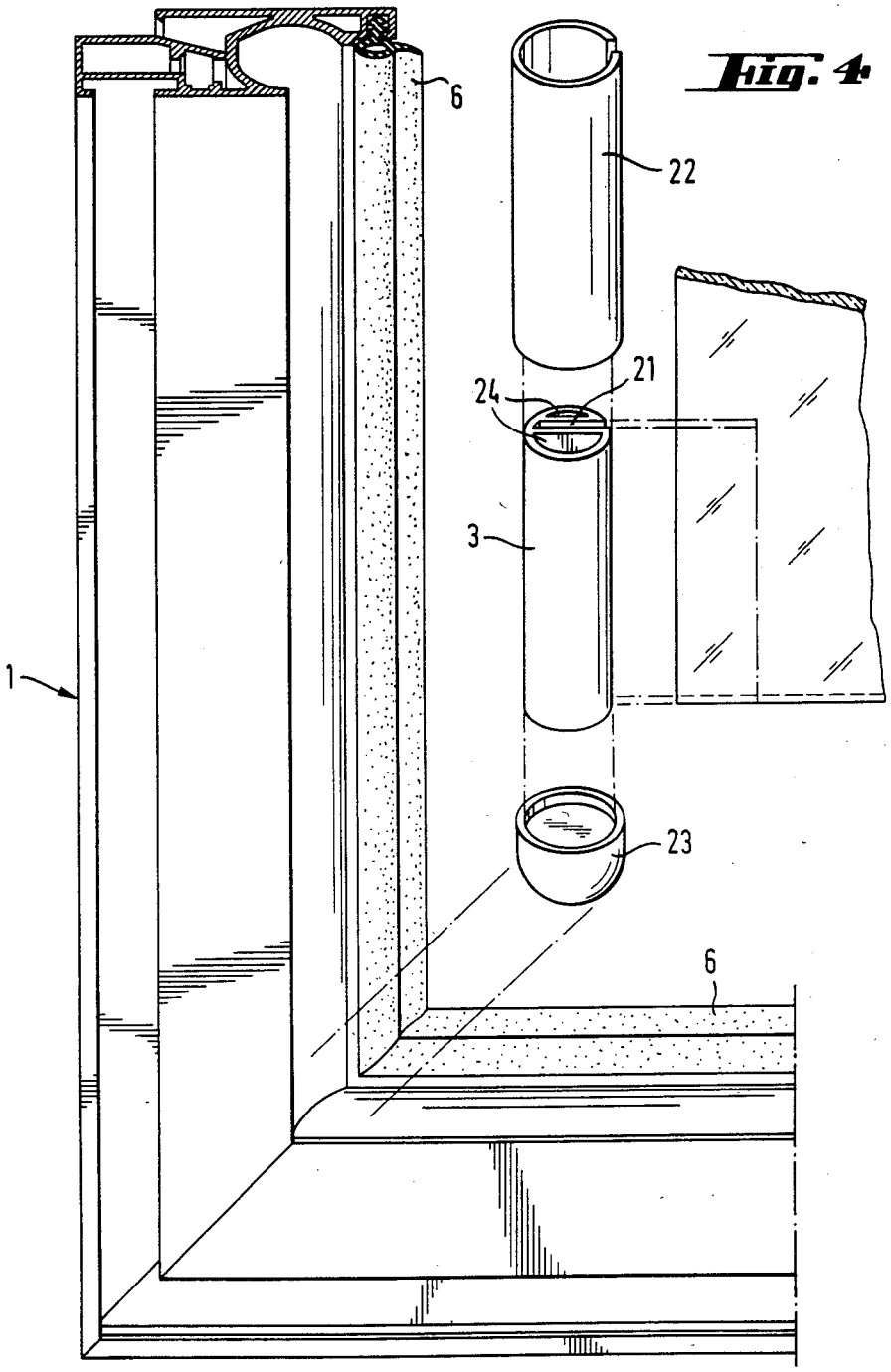
FIG. 4 is a perspective representation of a window corner according to the invention and the hinge belonging to it.
Figure 5B:
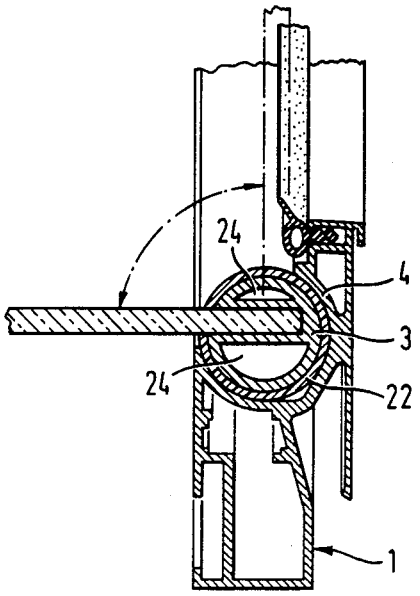
FIG. 5*b* depicts the same as FIG. 5*a*, but when the pane is in the open position.
Figure 5A:
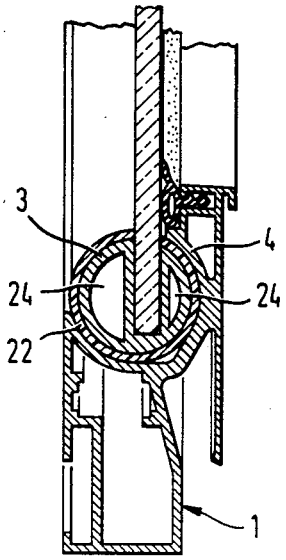
FIG. 5*a* depicts a cross section of the hinge according to the invention when the pane is in the closed position.
Figure 6:
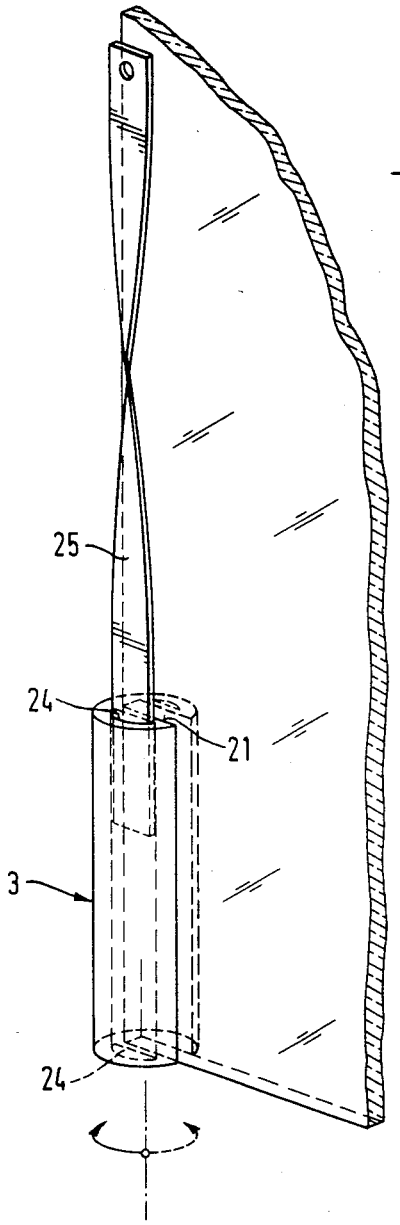
FIG. 6 a perspectiv representation of a hinge according to the invention with a flat spring fitted to it and attached to the frame.

FIGS. 3, 4, 5*a*, 5*b*, and 6 depict the structure and operation of a hinge according to the invention. The embodiment according to FIG. 4 is made up of a cylindrical hinge piece which has a notch 21 for the securing of the pane. Over the hinge piece 3 there is a sleeve-like bearing surface 22, the outer diameter of which corresponds to the inner diameter of the open tube and the inner diameter of which corresponds to the outer diameter of the a hinge piece. The bearing surface 22 is preferably of plastic or some other slippery-surfaced material. The hinge to be mounted in the lower corner of the window is detachably fastened to a hemispherical bearing piece 23, which in the corner of the window forms a readily moving hinge bearing. The bearing piece 23 is preferably of a thermosetting plastic or a similar material. Parallel to the notch 21 there are in the hinge piece openings (or bores) 24 which pass through. The openings 24 mean savings of material and at the same time they provide an opportunity to attach additional members to the hinge. FIG. 6 depicts the securing of a flat spring 25 to the opening 24 and to the frame. A flat spring thus fitted causes the window to open automatically when the latch has released it from locking. The pane-securing notch 21 is preferably formed somewhat eccentrically in the hinge piece, i.e. somewhat outwards from the center point in relation to the closed position of the pane. This causes the pane to be located closer to the outer edge of the structure and closer to the optimal so-called light-opening dimension of the structure. The diameters of the hinge piece 3 and the bearing surface 22 have been adjusted in such a way that the hinge with its bearing surface does not come out of the open tube, whereas a hinge from which the bearing surface has been pushed off fits through the said opening. The interior surface of the bearing surface 22 can also function as the primary bearing surface, in which case the hinge piece 3 slides against the said interior surface. In this case the bearing surface 22 has approximately the same cross sectional shape as the open tube has.

The hinge according to the invention functions well also without a detachable bearing surface. In such a case the hinge must be coated or covered with or it may be completely formed from a suitable slippery-surfaced material. In such a case the pane with its hinges 3 must be fitted in the open tube 4 of the frame profile before the closing of the frame at the corners.

It is evident from the above description that the latches and hinges according to the invention can be used also in conjunction with other structures such as doors, hatches, covers, etc., as long as the structure in question is fitted in a frame of an open-tube structure.

FIG. 9 shows as a cross section the right-side frame profile 32 for a window pane, the frame profile having a pocketlike opening 33. The edge 31*a* of the cover profile 31 according to the invention is pushed into the opening 33 and its other edge 31*b* has been shaped into a bend and sealed against the wall by means of a sealing tape. Two installation stage positions of the cover profile are illustrated by dotted lines in the figure. The edge 31*a* is simply pushed so deep into the opening 33 that the other edge 31*b* comes at a suitable sealing distance from the wall. If the clearance between the frame profile and the wall is narrower or wider at some distance from this point, the edge 31*a* will be further out of the opening 33 or respectively deeper in the opening 33 at that window height. If the depth of the opening 33 is not sufficient and the cover profile, when installed in place, is wider than the clearance available, the profile must be bent at another point so that the bend 31*b* becomes wider. This is an easy step, since the material of the profile is easy to work and the mere bending is not difficult.

FIG. 10 depicts a rectangular cover profile 31' fitted between the frame profiles of two adjacent windows. The width of this clearance has been precisely defined in advance, and the width of the cover profile is selected suitably so that it can be first pushed to the bottom of opening in one frame profile and then at its other edge inside the opening in the other frame profile.

Figure 11:
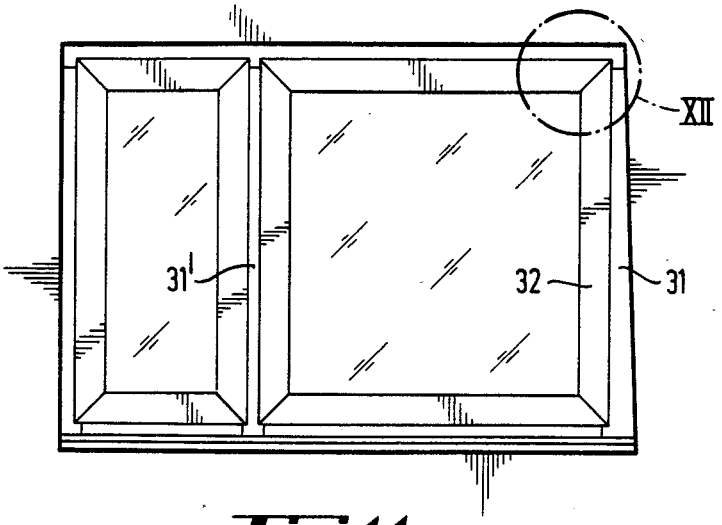
FIG. 11 depicts a front view of two adjacent windows fitted in the same window opening.
Figure 12:
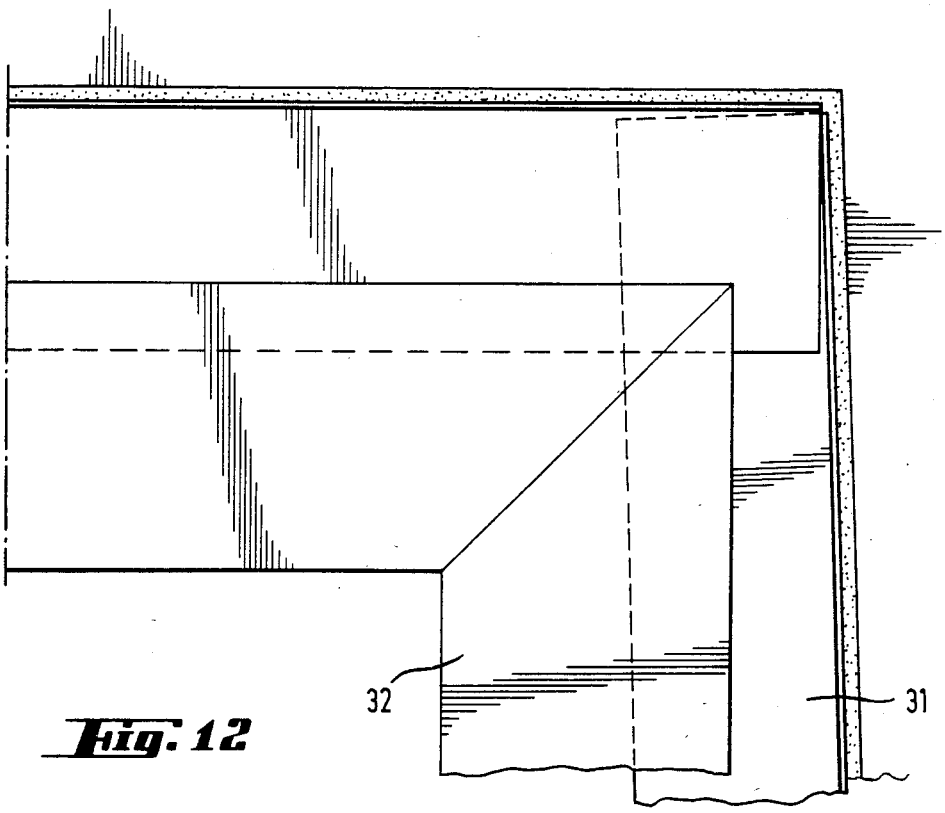
FIG. 12 depicts an enlargement of the top right-side corner of FIG. 11.

FIG. 11 illustrates two rectangular windows fitted into a slanted window opening. Nevertheless, the cover profile 32 neatly covers the clearance between the frame profile and the wall, and there have been no difficulties in installing the profile.

What is claimed is:

1. A window structure comprising:

a frame capable of being secured to a window opening, hinges fitted in the frame for movably securing the pane to the frame, and latches for opening and closing the pane, wherein said frame is made up of a profile the cross section of which is the same all around the frame, the interior part of the frame, which receives the pane, being made up of an open tube from which an axial mantle section has been removed, in which open tube there is fitted at least one latch turnable in the open tube to an extreme position which locks the pane and, after release of the locking, in the opposite direction, and in which open-tube part of one side of the frame there is fitted at least one hinge made up of a cylindrical hinge piece, turnable in the open tube, the edge of the pane being fitted to be secured to this hinge piece.

2. A window structure as in claim 1, wherein the profile (1) forming the frame can be secured to the frame structure of a completed window as a structure forming an additional pane.

3. A window as in claim 1, wherein the cylindrical hinge piece has a notch in which the edge of the pane is secured.

4. A window structure as in claim 1, wherein over the hinge piece there is provided a sleeve-like bearing surface, which is in contact with the interior surface of the open tube and is preferably removable from over the hinge piece by pushing said bearing surface in the axial direction.

5. A window structure as in claim 1, wherein at least the hinge (3) at the lower corner of the pane bears upon an approximately hemispherical bearing piece (23) capable of being secured detachably to the lower end of the hinge.

6. A window structure as in claim 1, wherein on either side of one of the hinge and the latch there is a detachable arc-shaped piece, fitted in the open tube of the frame, as a stop for the bearing surface of said one of the hinge and the latch.

7. A window structure as in claim 1, wherein on one side of the hinge the edges of the open tube are bent inwards by means of a suitable tool to prevent the bearing piece of the hinge from moving.

8. A window structure as in claim 1, wherein the latch is made up of a piece rotatably fitted in the open tube of the window structure and having on a circumference thereof a notch for the edge of the pane and, at a distance from said notch, a locking shoulder, the latch being fitted to turn to a locking extreme position in which the locking shoulder grips the edge of the open tube and the peripheral part of the latch ending in the notch bears on the opposite edge of the open tube, thereby locking the pane against the seal of the structure, and, after the release of the locking shoulder to turn freely in the opposite direction, in which the pane is free to be opened.

9. A window structure as in claim 8, wherein the latch locking shoulder is formed by removing a wedge-shaped part from the latch body.

10. A window structure as in claim 8, wherein several latches on the same side of the pane are linked together by means of a rod passing through said latches, only one single latch which serves as the operating and locking piece having a locking shoulder, the other latches turning between the locking and the opening position by transmission of movement via said rod.

11. A window structure as in claim 3, wherein the cylindrical hinge piece has axial bores.

12. A window structure as in claim 11, wherein a flat spring is fitted in one bore, one end of said spring being secured to the frame structure for automatically opening or closing the pane when the latch has released the pane.

13. A window structure as in claim 8, wherein on the circumference of the latch, between the notch and the locking shoulder, there is a protrusion as a grippable member for closing the latch.

14. A window structure as in claim 8, wherein an axial segment has been removed from the latch in an area approximately opposite the notch, in order to facilitate the removal and installation of the latch from the open tube.

15. A window structure as in claim 10, wherein on one side of the linked latches, there is a stop produced in the open tube, said stop comprising a bend made in the edges of the open tube, preventing the latch from moving in the open tube in a longitudinal direction.

16. A window structure of claim 1 including a cover profile adapted to fit into the frame of the window structure and to cover a clearance between two such window structures or between such a structure and the surrounding wall, wherein at least one edge of said cover profile is flat and fitted into a pocket-like opening in the frame part and wherein another edge of said cover profile is shaped so as to be connected to the adjacent wall or to the opening in the frame part of an adjacent window.

17. A window structure as in claim 16, wherein the cover profile is secured to the opening in the frame part by means of a screw or a spring.

18. A window structure as in claim 16, in which said cover profile is connected to the wall means of one of a rubber sealing profile, an adhesive sealing tape, and tightening of said cover profile between the wall and the attachment of the other edge.

19. A window structure as in claim 16, wherein the cover profile is formed of an easily workable thin sheet.

20. A window structure as in claim 16 wherein said one edge of said cover profile is secured to a pocket in the frame part of the lower edge the window and said another edge of said cover profile is bent to form a drip sheet.

* * * * *